US007857491B2

(12) United States Patent
Stegmaier

(10) Patent No.: US 7,857,491 B2
(45) Date of Patent: Dec. 28, 2010

(54) COOLING SYSTEM FOR A PROJECTOR

(75) Inventor: Klaus Stegmaier, Viechtach (DE)

(73) Assignee: Arnold & Richter Cine Technik GmbH & Co. Betriebs KG, Munich (DE)

( * ) Notice: Subject to any disclaimer, the term of this patent is extended or adjusted under 35 U.S.C. 154(b) by 289 days.

(21) Appl. No.: 11/990,565

(22) PCT Filed: Aug. 18, 2006

(86) PCT No.: PCT/EP2006/008181

§ 371 (c)(1),
(2), (4) Date: Feb. 15, 2008

(87) PCT Pub. No.: WO2007/020108

PCT Pub. Date: Feb. 22, 2007

(65) Prior Publication Data

US 2009/0133857 A1 May 28, 2009

(30) Foreign Application Priority Data

Aug. 18, 2005 (DE) ..... 20 2005 013 244 U

(51) Int. Cl.
*F21V 29/00* (2006.01)

(52) U.S. Cl. ..... 362/373; 362/294

(58) Field of Classification Search ..... 362/294, 362/345, 373; 353/57–61
See application file for complete search history.

(56) References Cited

U.S. PATENT DOCUMENTS 1,758,290 A 5/1930 McCormack
4,546,420 A 10/1985 Wheeler et al.
4,658,338 A 4/1987 Bertozzi
4,925,295 A * 5/1990 Ogawa et al. ..... 353/57
5,099,399 A * 3/1992 Miller et al. ..... 362/580
5,172,975 A 12/1992 Parker (Continued)

FOREIGN PATENT DOCUMENTS

DE 35 23 851 A1 1/1987

(Continued)

OTHER PUBLICATIONS

International Search Report, dated Nov. 7, 2006, corresponding to PCT/EP2006/008181.

(Continued)

*Primary Examiner*—Alan Cariaso
(74) *Attorney, Agent, or Firm*—Christie, Parker & Hale, LLP

(57) ABSTRACT

A cooling system for a projector for dissipating the heat output by a light source and/or optical components or electric and electronic components through which current flows in a projector housing with a lamp housing and a base tray is provided. The cooling system comprising a first cooling device in which a first convection flow is guided through the interior space of the base tray and the lamp housing and around which a second convection flow circulates which circulates around the lamp housing at least partially in the circumferential direction, and a second cooling device for a cooling air flow which is directed substantially perpendicularly to the second convection flow and runs parallel to the optical axis of the projector.

12 Claims, 6 Drawing Sheets

U.S. PATENT DOCUMENTS

| | | | | |
|---|---|---|---|---|
| 5,367,444 | A | | 11/1994 | Bornhorst et al. |
| 6,111,630 | A | * | 8/2000 | Watanuki et al. ..... 349/161 |
| 6,494,600 | B2 | | 12/2002 | Liang et al. |
| 2006/0044777 | A1 | | 3/2006 | Dorner |

FOREIGN PATENT DOCUMENTS

| | | | |
|---|---|---|---|
| DE | 195 09 480 | A1 | 9/1996 |
| DE | 101 21 658 | A1 | 9/2002 |
| GB | 1 201 894 | | 8/1970 |
| WO | WO 93/20384 | | 10/1993 |
| WO | WO2004/029507 | A1 | 4/2004 |
| WO | WO 2004/029507 | A1 | 4/2004 |

OTHER PUBLICATIONS

English translation of International Preliminary Report on Patentability dated Jun. 19, 2008 corresponding to PCT/EP2006/008181.

* cited by examiner

COOLING SYSTEM FOR A PROJECTOR

CROSS-REFERENCE TO A RELATED APPLICATION

This application is a National Phase Patent Application of International Patent Application Number PCT/EP2006/008181, filed on Aug. 18, 2006, which claims priority of German Utility Model Application Number 20 2005 013 244.6, filed on Aug. 18, 2005.

BACKGROUND

The invention relates to a cooling system for a projector.

WO 2004/029 507 A1 discloses a projector that has a light source that is arranged in a projector housing, is capped at one or two ends and comprises a lamp or a burner, for example a discharge lamp in the form of a metal-halide lamp, and a reflector that reflects the light emitted by the light source in the direction of a front opening of the projector housing that can be sealed by a transparent cover element, for example a protective disk or lens disk.

In addition to radiating visible light beams, a burning light source also produces in its arc or filament invisible thermal radiation that lies in the infrared spectral range and is output by the following three processes to the surroundings of the light source:

a) the thermal radiation is partially absorbed by the components surrounding the light source, such as reflector, light source base and supply leads to the light source, and by the projector housing, which components thereby experience negative influence on their material properties and themselves act as secondary heat source,
b) thermal conduction takes place via the electric contacts and via the ceramic body of the light source base, and
c) the ambient air of the light source is heated up, rises upward and entrains cooler air upward from below in a convective cooling process.

In order to support the last-named process and to provide a projector of high power with a compact design, the projector housing disclosed in WO 2004/029 507 A1 comprises an upper, cylindrical projector housing part and a lower projector housing part that is of cuboidal design and on which ventilation shafts with mutually separate ventilation ducts are arranged. The ventilation ducts are separated from one another by fins that have inside the ventilation shaft a first fin section adjacent to the air entrance openings, and a second fin section, which is adjacent to the air exit openings and is bent away from the first fin section.

U.S. Pat. No. 5,172,975 A discloses a projector with a light source, a reflector and a light exit opening in a cylindrical projector housing on which there are formed ventilation ducts that likewise circulate for convective cooling of the surroundings of the light source outputting heat, and are delimited by fins. The fins are bent away outside the cylindrical projector housing and are flanged at their ends so that, firstly, light is prevented from exiting from the interior of the projector housing and, secondly, the flow of air is directed away perpendicularly from the projector housing.

U.S. Pat. No. 1,758,290 A discloses a projector housing with ventilation shafts, which are arranged on the housing walls, have ventilation ducts separated from one another and are separated from one another by fins such that uniform ventilation ducts are produced via which cooling air flows into the interior of the projector housing. The ends, projecting into the interior of the projector housing, of the fins above and below the optical axis of the projector are bent away again in respectively opposite directions such that the ends of the fins arranged above the optical axis are directed toward the underside of the projector housing, while the ends, arranged below the optical axis, of the fins are directed toward the top side of the projector housing, and the two sections are connected to one another in a central horizontal part such that improved circulation of cooling air through the projector housing is attained by the different alignment of the ends, located in the interior of the projector housing, of the fins.

In addition to the thermal radiation output by the light source, heat from further electric and electronic components, such as an ignitor and the electric supply leads, is also output to the interior of the projector housing, which is likewise to be dissipated by a convective cooling process.

Another problem in the dissipation of heat from a projector housing lies in the fact that, if the projector is tilted with respect to the horizontal, the convective flow of air is guided into higher parts of the projector housing, so that local overheating and, as a consequence, damage to or destruction of components can easily occur.

In order to provide sufficient space for the convective flow of air and to dissipate the heated air more effectively to the surroundings of the projector, the projector housings of known projectors have a larger volume and their outer surfaces are strongly ribbed in order to increase the area of the housing which outputs the heat.

SUMMARY

It is an object of the present invention to specify a cooling system for a projector of the type mentioned at the beginning, which cooling system dissipates the heat output by a light source and by other components of the projector as effectively as possible even with the projector tilted with respect to the horizontal, and with minimal housing dimensions, and effectively cools components located in the interior of the projector housing.

The inventive solution utilizes a convective flow of air in the interior of the projector housing as well as a convection flow circulating around the projector housing and also a cooling air flow directed perpendicularly or transversely at least to the convection flow circulating around the projector housing. While the inner convection flow takes up the heat output by the light source and the heat-generating components, rises upward and entrains cooler air upward from below, the convection flow circulating around the projector housing cools the projector housing. The cooling air flow which runs transversely to these flows dissipates the thermal load in the convection flow partially and in particular also if the projector is operated such that it is tilted with respect to the horizontal.

Another advantage of the inventive solution lies in the fact that the cooling air flow surrounding the convective flows of air is significantly cooler than the convective flows of air, so that the cooling system according to the invention also ensures improved contact protection.

Accordingly, the cooling system for a projector for dissipating the heat output by a light source and/or optical components or electric and electronic components through which current flows in a projector housing with a lamp housing and a base tray, with a first convection flow, which is guided inside the base tray and the lamp housing of the projector housing, is characterized by a first cooling device for a second convection flow circulating around the lamp housing at least partially in the circumferential direction and by a second cooling device for a cooling air flow which is directed substantially perpendicularly to the second convection flow and runs parallel to the optical axis of the projector.

An exemplary refinement of an exemplary solution of the invention is characterized in that the first cooling device contains a jacket flow guide plate which is arranged in the lamp housing, into whose interior space the first convection flow is guided and around which the second convection flow flows, while the second cooling device comprises cooling ducts which are arranged in the lamp housing around the jacket flow guide plate radially spaced apart therefrom such that they extend parallel to the optical axis of the projector and which guide the cooling air flow in the longitudinal direction of the projector housing, with the cooling ducts being arranged at a small radial spacing from the jacket flow guide plate and the second convection flow flowing through the gap formed between the jacket flow guide plate and the cooling ducts.

The arrangement of a jacket flow guide plate is used to guide the convection flows and the cooling air flow in a targeted manner, with the formation of a gap between the jacket flow guide plate and the cooling ducts arranged at a small radial spacing from the jacket flow guide plate being used to improve the convection flow guided around the jacket flow guide plate and to output some of the thermal load to the cooling ducts.

Exemplary, first openings are arranged in the upper section of the jacket flow guide plate, which upper section is counter to the direction of gravity, and are used for the dissipation of heat from the internal convection flow to the external convection flow or the cooling ducts and the surroundings.

It is furthermore possible for second openings for the passage of the convection flow to be provided between the cooling ducts which extend substantially parallel to the optical axis, with the second openings serving for the dissipation of the heated air to the surroundings.

In order to ensure the dissipation of the heated air to the surroundings over the entire length of the projector, the second openings are, according to a further feature of the invention, designed to lead through from the front face to the rear face of the projector housing such that they extend parallel to the optical axis of the projector.

An exemplary development of the invention is characterized in that a plurality of second openings which are distributed across the circumference of the projector housing are provided, so that the heat dissipated by means of the convection flow does not result in excessive heating of the projector housing counter to the direction of gravity, i.e. from the bottom up.

The first and second openings are arranged offset with respect to one another in the circumferential direction of the projector housing in order to prevent scattered light from exiting the projector housing.

The cooling ducts preferably form cooling duct openings at the front and rear faces of the projector housing such that a cooling air flow is produced which is increased if the projector is tilted in one direction or the other and ensures effective dissipation of heat particularly in these critical operating states of the projector.

In order to increase the dissipation of heat, the jacket flow guide plate can be painted with a heat-resistant black lacquer and comprise an aluminum cast or pressure diecast alloy.

Exemplary, the jacket flow guide plate can be provided with a ceramic coating with low reflection coefficient which is preferably applied in a plasma-chemical finishing process.

Producing a firmly adhering oxide ceramic/metal compound on the jacket flow guide plate results in a high heat resistance in particular of the coloration, which has a low reflection coefficient and does not flake with time even under the influence of heat, of the jacket flow guide plate.

In one exemplary embodiment of the inventive solution, the projector housing comprises a substantially cylindrical lamp housing, in which a light source and a reflector are arranged, which reflector reflects the light beams emitted by the light source to a light exit opening of the lamp housing, the light exit opening being covered by a transparent plate, and a substantially cuboid or polygonal base tray which is arranged in the direction of gravity beneath the lamp housing and in which electric and electronic components, such as an ignitor, cable leads and the like are arranged, wherein the lamp housing surrounds the jacket flow guide plate and the cooling ducts, the base tray has air entrance openings for cooling air and the air heated in the base tray is directed into the interior space of the jacket flow guide plate of the lamp housing arranged above the base tray.

This exemplary embodiment of the inventive solution ensures an optimized convection flow for dissipating the heat output by the electric and electronic components in the base tray and the thermal radiation output by the light source in the lamp housing even if a projector is operated in tilted fashion with respect to the horizontal, and enables a projector housing with minimal dimensions, while at the same time achieving improved contact protection.

BRIEF DESCRIPTION OF THE DRAWINGS

The concept on which the invention is based will be explained in more detail with reference to an exemplary embodiment illustrated in the figures, in which.

DETAILED DESCRIPTION

Figure 1:
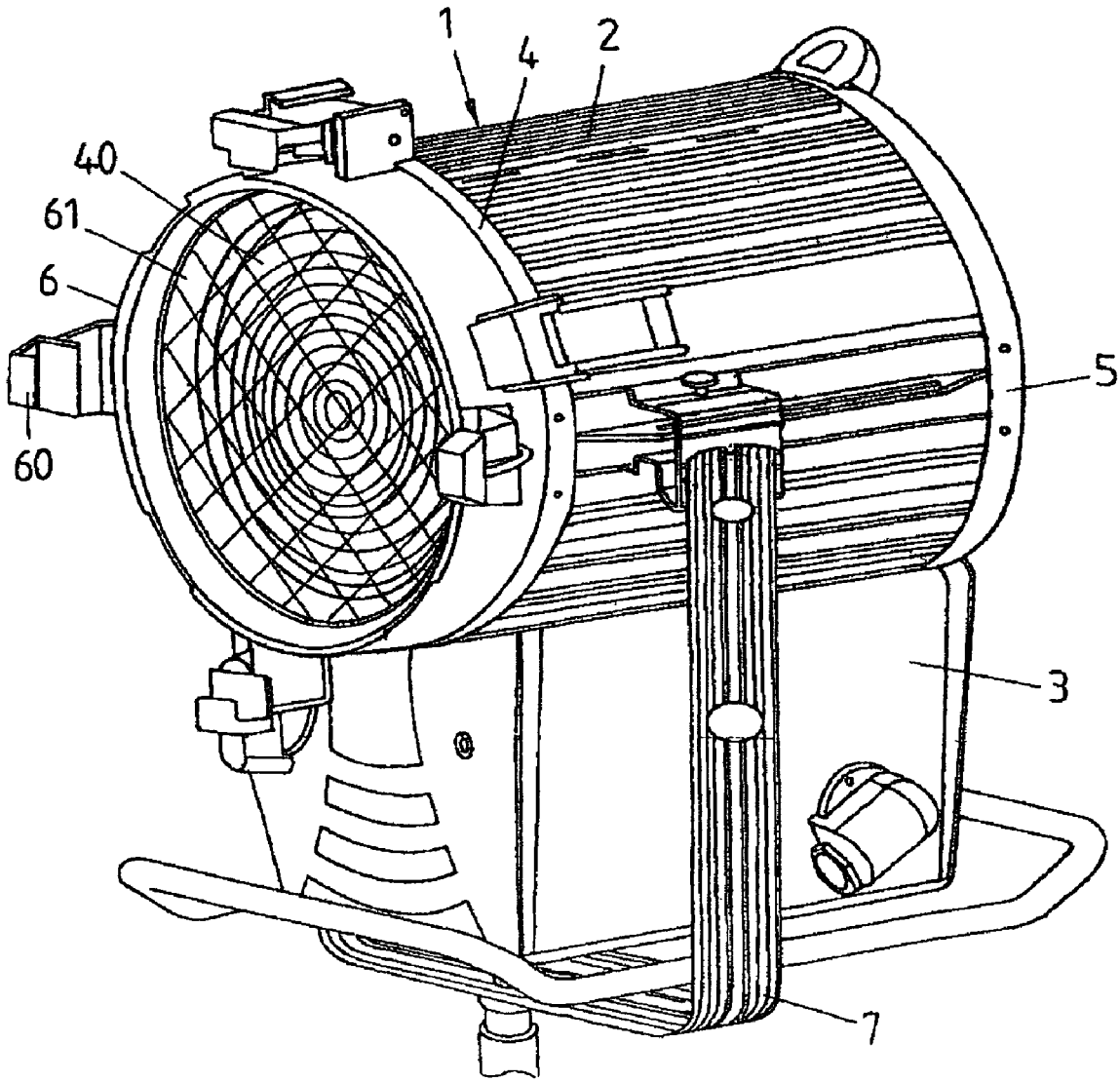
FIG. 1 shows a perspective front face view of a projector for the illumination of a stage, studio, film sets, TV sets and events with a crossflow cooling system according to the invention.

FIG. 1 shows in a perspective front face view a projector with a projector housing 1, which includes of a lamp housing 2 and a base tray 3. The lamp housing 2 has a front part 4 and a rear part 5 which are customarily produced from aluminum pressure diecast. The front part 4 contains a front lens 40 and is connected to a lens mount or attachment 6 which contains, uniformly distributed over the circumference, four holding claws 60 for receiving attachment elements such as diffusers, filter disks, protective disks and the like and is connected via a clamping apparatus (not described in any more detail) to the lamp housing 2. In order to connect the projector housing 1 to a stand or a ring, so that the projector can be arranged such that it can stand or be suspended, a holding bracket 7 is connected to the lamp housing 2 via a bracket linkage. Corresponding to the cross-sectional representation in FIG. 3, the lamp housing 2 surrounds a lamp or a burner 8 and a reflector 9 which reflects the light beams emitted by the lamp or the burner 8 in the direction of the front lens 40 according to FIG. 1.

According to FIGS. 1 to 3, 5 and 6, the lamp housing 2 contains a jacket flow guide plate 20 and a plurality of cooling ducts 21 to 26 which are arranged around the jacket flow guide plate 20, extend parallel to the optical axis of the projector and have a profiled, but not necessarily ribbed outer surface for increasing the heat-emitting area. The cooling ducts 21 to 26 are arranged at a small spacing from the jacket flow guide plate 20, so that a gap 10 is formed between the jacket flow guide plate 20 and the cooling ducts 21 to 26.

In order to increase the dissipation of heat, the jacket flow guide plate 20 is painted with a heat-resistant black lacquer and preferably comprises an aluminum cast or pressure diecast alloy. Alternatively, the jacket flow guide plate 20 can be provided with a firmly adhering ceramic coating with low reflection coefficient, which is applied in a plasma-chemical finishing process, for increasing the heat resistance. The plasma-chemical process takes place in specific aqueous organic electrolytes in which the jacket flow guide plate 20 is connected as an anode, with the result that the metal is partially molten under the influence of the oxygen plasma produced in the electrolyte on the surface of the jacket flow guide plate 20 and a firmly adhering oxide ceramic/metal compound having good scatter properties is produced on the jacket flow guide plate 20.

Figure 3:
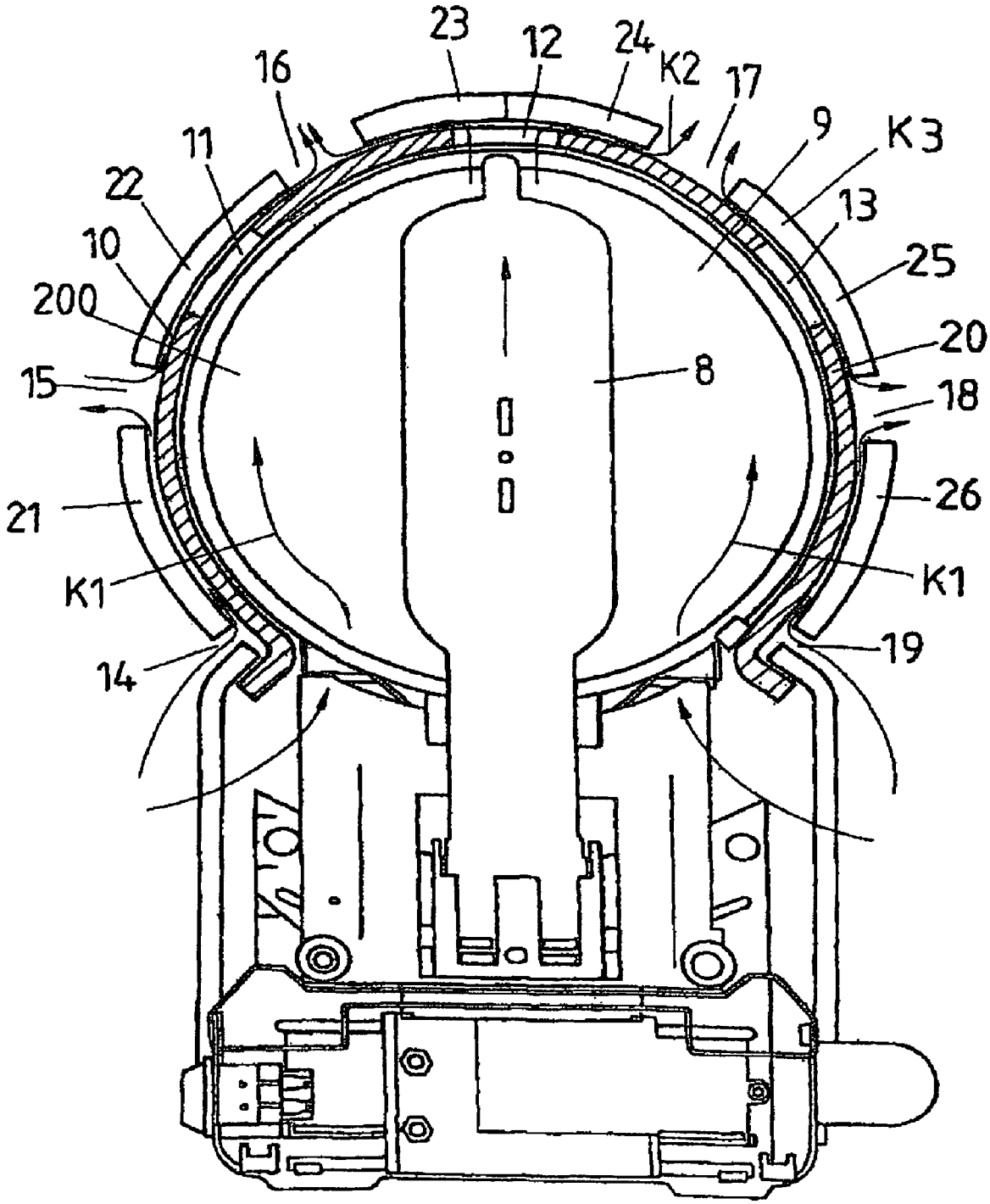
FIG. 3 shows a cross section through the projector according to FIGS. 1 and 2.

The jacket flow guide plate 20 is open in the direction of the base tray 3 and has, according to the cross-sectional representation in FIG. 3, an omega cross-sectional shape. The jacket flow guide plate 20 has, in its surface which lies opposite the base tray 3, a plurality of first openings 11, 12, 13 (which can be gathered from both the cross section of FIG. 3 and the longitudinal section according to FIG. 5) which are arranged one next to the other and one after the other in the direction of the optical axis of the projector and opposite which cooling ducts 22, 23, 24, 25 are located on the outer surface at the spacing of the gap 10.

Second openings 14 to 19 through which cooler ambient air flows in and heated air flows out are formed between the cooling ducts 21 to 26 and between the, in the circumferential direction, outer cooling ducts 21 and 26 and the base tray 3.

Arrows are drawn symbolically in the cross-sectional representation according to FIG. 3, with the arrows characterizing the different air flows in the interior and at the outer surface of the jacket flow guide plate 20. Cooler external air passes into the base tray 3 via air entrance openings (not illustrated in any more detail) in the base tray 3 and guides the heat output there by the electric and electronic components located in the base tray 3, such as the ignitor of the projector and electric cables and control elements, for example, into the interior space 200 of the lamp housing 2 which is closed off by the jacket flow guide plate 20. The thermal radiation output by the lamp or the burner 8 heats up the circulating inner or first convection flow K1 further in the interior space 200 of the jacket flow guide plate 20 of the lamp housing 2, and transfers some of the heat to the jacket flow guide plate 20 and, via the first openings 11, 12, 13 arranged in the upper region of the jacket flow guide plate 20, into the gap 10 formed between the jacket flow guide plate 20 and the cooling ducts 21 to 26.

Air for the outer or second convection flow K2 is sucked in via the openings 14, 19 which are formed between the, in the circumferential direction, outer cooling ducts 21, 26 and the base tray 3, with the convection flow K2 being guided around the jacket flow guide plate 20 and dissipating the thermal load partially to the cooling ducts 21 to 26 and via the second openings 15, 16, 17, 18 to the surroundings.

Figure 2:
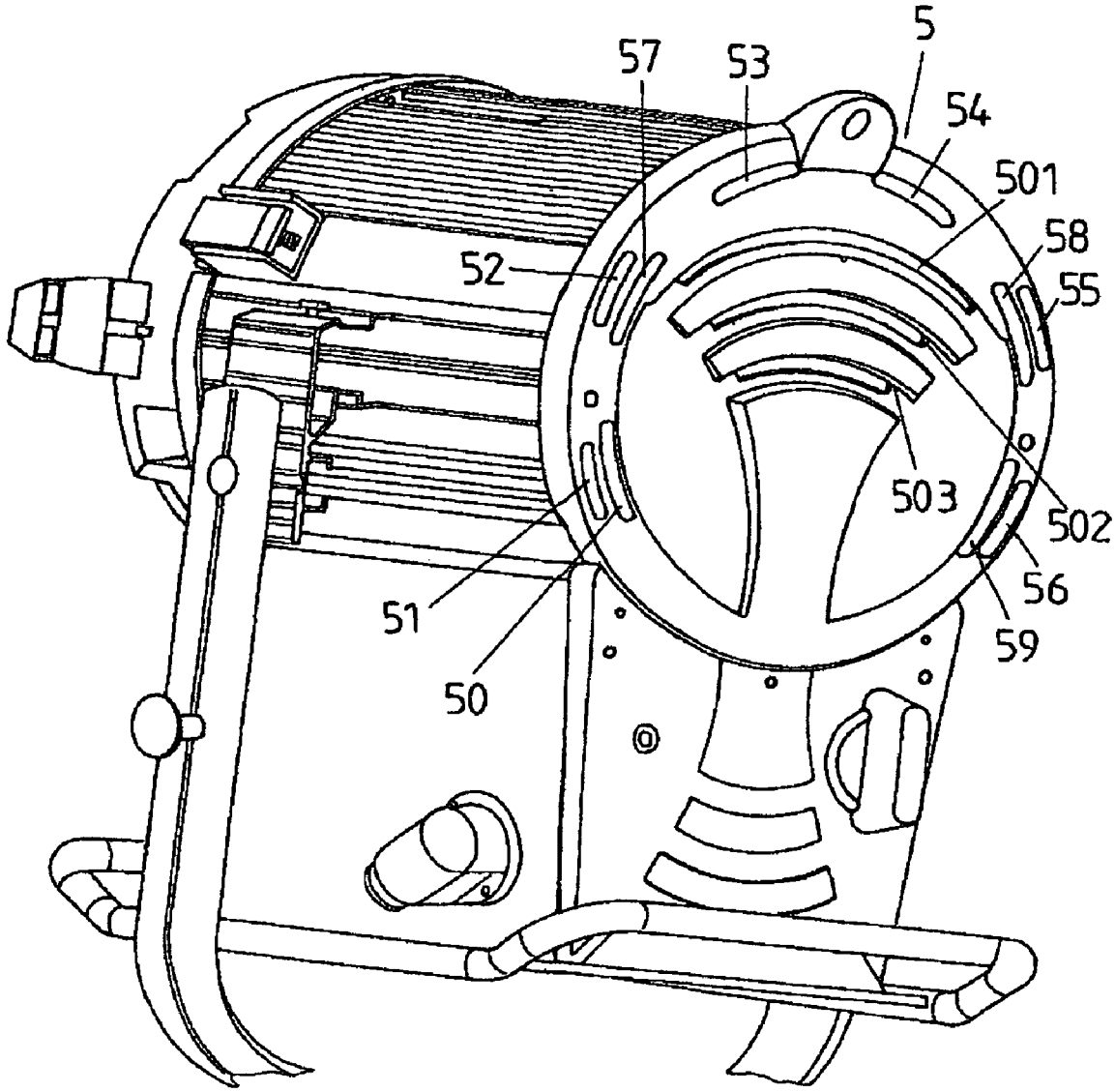
FIG. 2 shows a perspective rear face view of the projector according to FIG. 1.
Figure 4:
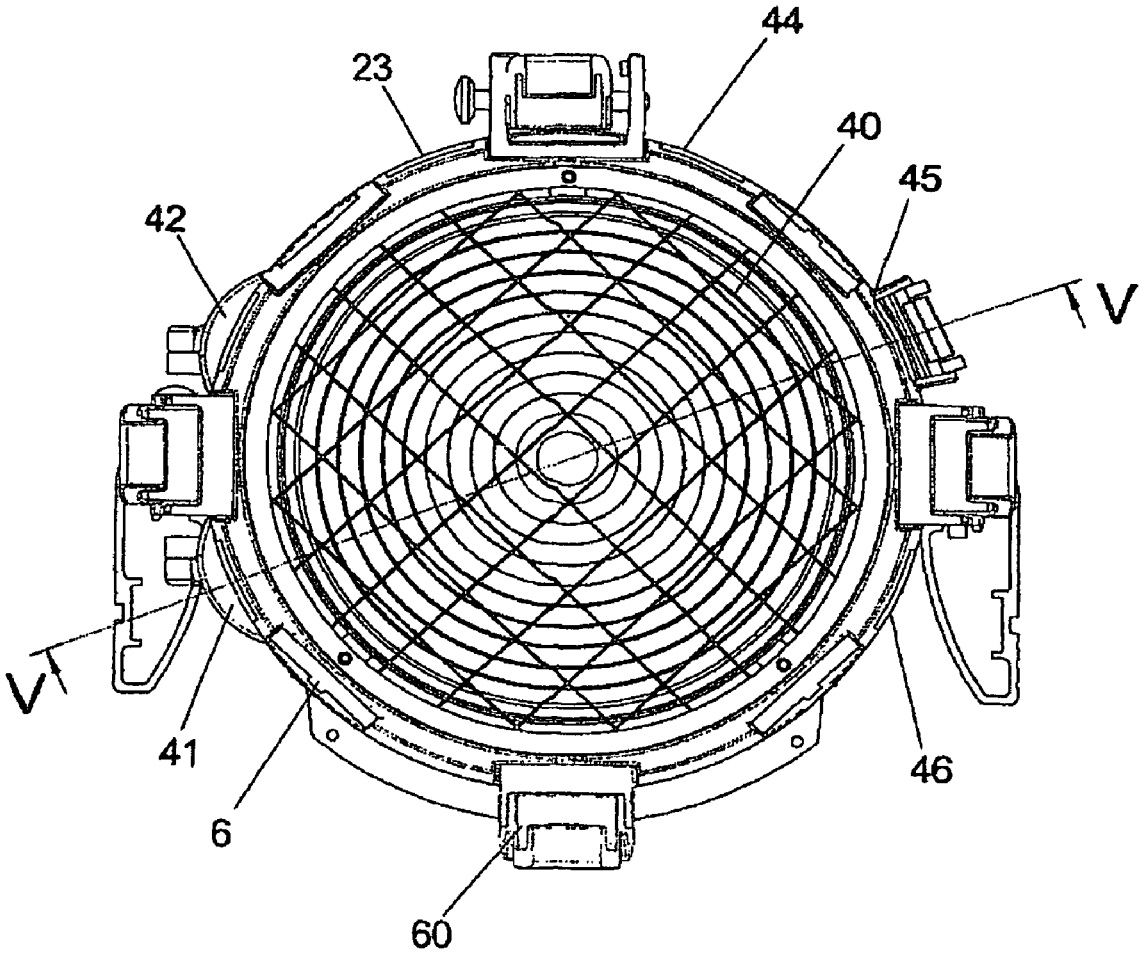
FIG. 4 shows a front view of the projector housing according to FIGS. 1 to 3.
Figure 5:
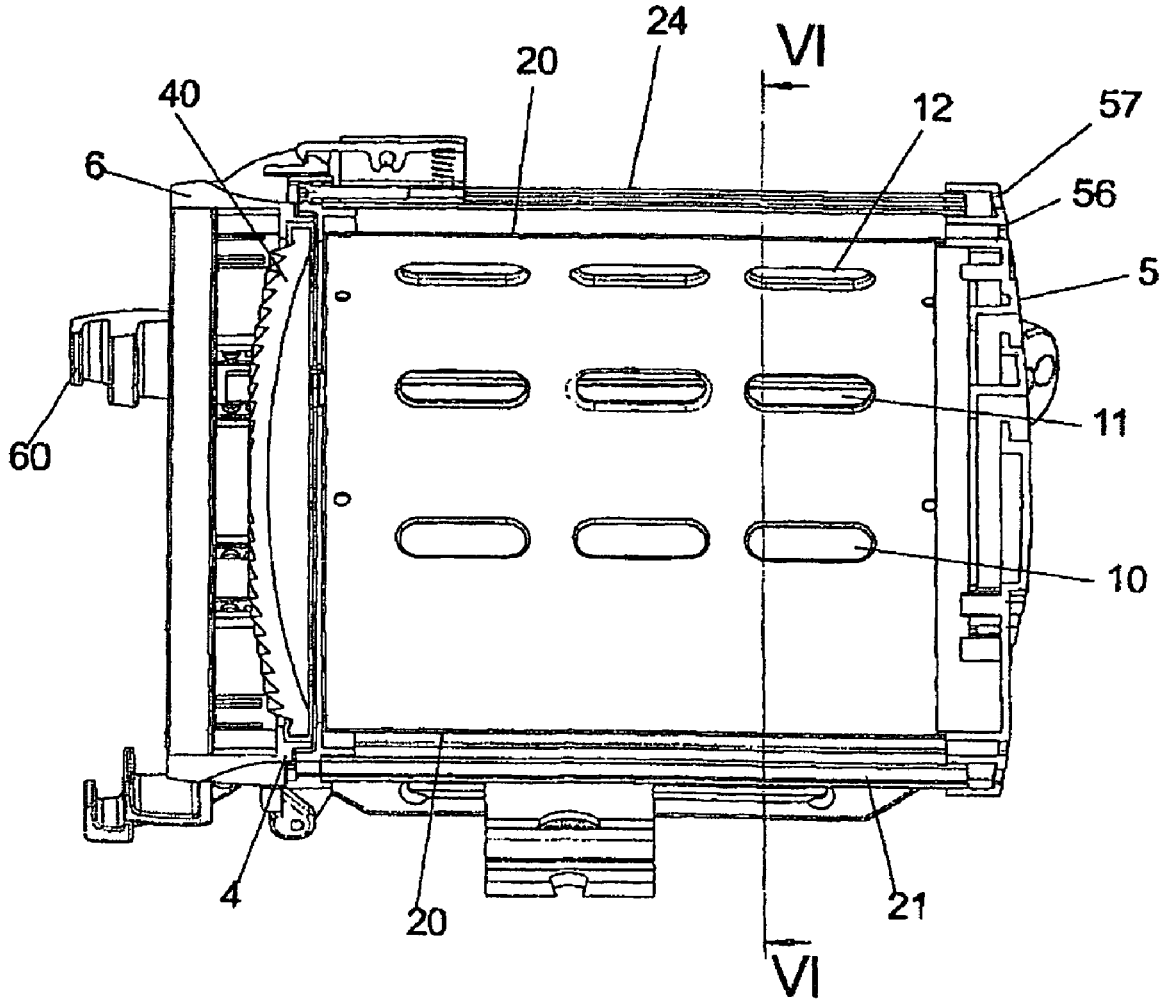
FIG. 5 shows a longitudinal section through the projector housing along the line A-A according to FIG. 4.
Figure 6:
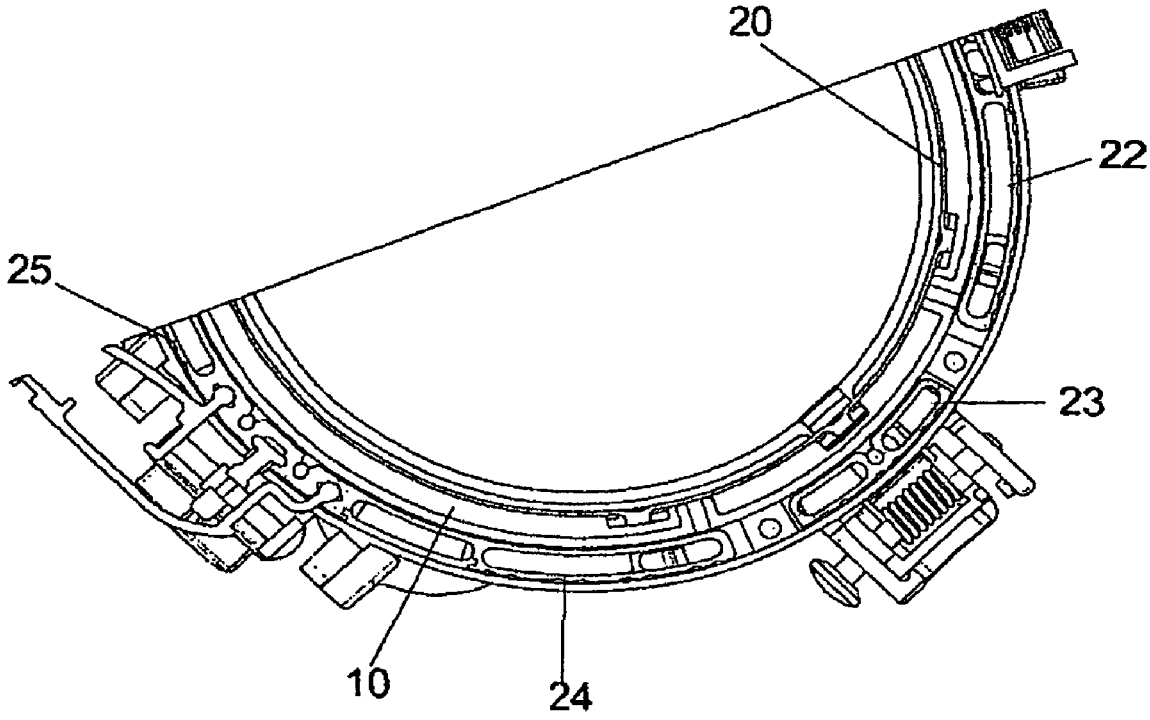
FIG. 6 shows a cross section through the projector housing along the line B-B according to FIG. 5.

A cooling air flow K3 is guided, perpendicularly to the inner and outer or first and second convection flows K1 and K2 which are guided inside the jacket flow guide plate 20 and around the jacket flow guide plate 20, into the cooling ducts 21 to 26 which are guided according to FIG. 4 via front-face cooling duct openings 41 to 46 of the cooling ducts 21 to 26 and according to FIG. 2 via rear-face cooling duct openings 51 to 56. The cooling air flow K3, which is guided through the cooling ducts 21 to 26, is directed, if the projector is tilted downward, from the front-face cooling duct openings 41 to 46 as inlet openings to the rear-face cooling duct openings 51 to 56 as outlet openings and, if the projector is aimed upward, from the rear-face cooling duct openings 51 to 56 as inlet openings to the front-face cooling duct openings 41 to 45 as outlet openings.

In addition, openings 50, 57, 58, 59, via which the outer convection flow K2 which is guided on the outside of the jacket flow guide plate 20 is transferred by the rear part 5 to the surroundings, can be arranged in the rear part 5 of the projector housing 1 on the outer periphery of the rear part 5 when the projector is tilted.

Furthermore, covered air exit slits 501, 502, 503, via which heated air located in the interior space 200 of the lamp housing 2, i.e. inside the jacket flow guide plate 20, can be dissipated in particular if the projector is tilted, can be provided in the region of the central area of the rear part 5.

It also lies within the scope of the present invention to provide cooling ducts arranged laterally on the base tray 3 in accordance with WO 2004/029507 A1 cited above and to provide rectilinear or kinked fins for the targeted air flow guidance for a convection flow.

The invention claimed is:

1. A cooling system for a projector for dissipating heat output by at least one of a light source, optical components, and electrical and electronical components, wherein the projector comprises a projector housing with a lamp housing and a base tray, said cooling system comprising:

a first cooling device guiding a first convection flow and a second convection flow, said first convection flow being guided through an interior space of the base tray and the lamp housing, said second convection flow circulating at least partially in a circumferential direction around the lamp housing, and said first cooling device comprising a jacket flow guide plate which is arranged in the lamp housing and which comprises a section with first openings; and a second cooling device for a cooling air flow which is substantially directed parallel to an optical axis of the projector and perpendicular to said second convection flow, said second cooling device comprising cooling ducts which are arranged in the lamp housing around the jacket flow guide plate radially spaced apart, said cooling ducts being oriented substantially parallel to the optical axis of the projector, said second cooling device further comprising second openings between said cooling ducts for the passage of said first and second convection flows, and said second openings extending substantially parallel to the optical axis of the projector leading from a front face to a rear face of the lamp housing.

2. The cooling system of claim 1, wherein said first openings are arranged in an upper section of said jacket flow guide plate.

3. The cooling system of claim 1, wherein said jacket flow guide plate has an omega shape in cross-section.

4. The cooling system of claim 1, wherein said cooling ducts are arranged at a small radial spacing from the jacket flow guide plate and wherein said second convection flow flows through a gap formed between said jacket flow guide plate and said cooling ducts.

5. The cooling system of claim 1, wherein said first and second openings are displaced against each other in the circumferential direction of the lamp housing.

6. The cooling system of claim 1, wherein said cooling ducts form cooling duct openings at the front and rear faces of the lamp housing.

7. The cooling system of claim 1, wherein said jacket flow guide plate is painted with a heat-resistant black lacquer.

8. The cooling system of claim 1, wherein said jacket flow guide plate comprises at least one of an aluminium cast and a pressure diecast alloy.

9. The cooling system of claim 1, wherein said jacket flow guide plate has a ceramic coating with a low reflection coefficient, which is applied using a plasma-chemical finishing process.

10. The cooling system of claim 1, wherein said lamp housing is substantially cylindrical and comprises said jacket flow guide plate and said cooling ducts, and wherein a light source and a reflector are arranged, said reflector reflecting the light beams emitted by said light source to a light exit opening of the lamp housing, said light exit opening being covered by a transparent plate.

11. The cooling system of claim 1, wherein said base tray is substantially polygonally shaped and arranged in the direction of gravity beneath the lamp housing, and wherein in said base tray electric and electronic components are arranged.

12. The cooling system of claim 11, wherein said base tray has openings for cooling air and wherein air heated by functional elements in said base tray is directed into the interior space of said jacket flow guide plate of the lamp housing arranged above said base tray.

* * * * *